US007734243B2

(12) United States Patent
Takiguchi et al.

(10) Patent No.: US 7,734,243 B2
(45) Date of Patent: Jun. 8, 2010

(54) IMAGE FORMING APPARATUS

(75) Inventors: Toshiki Takiguchi, Yamatokoriyama (JP); Kouji Wakamoto, Kitakatsuragi (JP); Tatsuya Inoue, Nara (JP); Yasuhiro Takai, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 601 days.

(21) Appl. No.: 11/336,901

(22) Filed: Jan. 23, 2006

(65) Prior Publication Data

US 2006/0165452 A1 Jul. 27, 2006

(30) Foreign Application Priority Data

Jan. 24, 2005 (JP) ..... 2005-016171

(51) Int. Cl.
*G03G 15/00* (2006.01)

(52) U.S. Cl. ..... 399/388; 399/361; 399/381

(58) Field of Classification Search ..... 399/66, 399/121, 154, 159, 297–309, 361, 363, 381, 399/388–396; *G03G 15/00*
See application file for complete search history.

(56) References Cited

U.S. PATENT DOCUMENTS 4,128,327 A * 12/1978 Sugiyama et al. ..... 399/396
5,159,393 A * 10/1992 Hiroshima et al. ..... 399/313

FOREIGN PATENT DOCUMENTS

JP 63257769 A * 10/1988
JP 3-101769 A 4/1991
JP 9-68874 A 3/1997
JP 09244317 A * 9/1997
JP 9-301556 A 11/1997
JP 10-129893 A 5/1998
JP 10-254204 A 9/1998
JP 10254204 A * 9/1998
JP 2001-5310 A 1/2001
JP 2004-149265 A 5/2004

OTHER PUBLICATIONS

Machine translation of JP 10254204 A.*
Machine Translation of JP 09244317 A.*

* cited by examiner

*Primary Examiner*—Judy Nguyen
*Assistant Examiner*—Wyn' Q Ha
(74) *Attorney, Agent, or Firm*—Birch, Stewart, Kolasch & Birch, LLP

(57) ABSTRACT

In an image forming apparatus of the present invention, an idle roller once stops rotating when a front edge of a sheet conveyed reaches the idle roller. The idle roller restarts rotating at such a timing that a front edge of a toner image on a photoreceptor and a front edge of an image writing position on the sheet are aligned with each other. Then, even if a rear edge of the sheet is still in the idle roller, the idle roller stops rotating when the front edge of the sheet is sandwiched between a transfer roller and the photoreceptor. By carrying out such operations, it is possible to avoid by a very simple way an occurrence of a slip phenomenon that is a phenomenon of slipping of the sheet with respect to the photoreceptor while suppressing a reduction in image quality as much as possible. In addition, it is also possible to surely secure a blank space formed at a rear edge portion of the sheet.

14 Claims, 10 Drawing Sheets

IMAGE FORMING APPARATUS

This Nonprovisional application claims priority under 35 U.S.C. §119(a) on Patent Application No. 16171/2005 filed in Japan on Jan. 24, 2005, the entire contents of which are hereby incorporated by reference.

FIELD OF THE INVENTION

The present invention relates to an image forming apparatus which visualizes an electrostatic latent image formed on an electrostatic latent image bearing member, so as to form a visible image, and then transfers the visible image to a recording material while conveying the recording material.

BACKGROUND OF THE INVENTION

An image forming apparatus causes a writing device to form on a photoreceptor (electrostatic latent image bearing member) an electrostatic latent image based on image information, and visualizes the electrostatic latent image with a toner (developer) so as to form a toner image (visible image). Then, a transfer device transfers the toner image from the photoreceptor to a sheet that is a recording material.

In the case in which the transfer device is a transfer roller, the toner image is transferred to the sheet by (i) supplying the sheet to a transfer nip portion where the photoreceptor and the transfer roller are compressed against each other, and (ii) conveying the sheet (recording material) by rotational forces of the photoreceptor and the transfer roller. Because a transfer voltage is applied to the transfer roller, the sheet passing through the transfer nip portion is electrically charged by the transfer voltage. Therefore, the toner on the photoreceptor is absorbed by the sheet.

Incidentally, a peripheral velocity of the transfer roller is higher than that of the photoreceptor. Therefore, the sheet once sticks to the photoreceptor, but is pulled due to the difference in peripheral velocity between the photoreceptor and the transfer roller. Thus, the sheet is separated from the photoreceptor. This arrangement is made to avoid deterioration in printing quality, such as hollow characters and halftone thin dots caused due to a separation discharge generated when the sheet is separated from the transfer nip portion.

That is, the transfer voltage is applied to the transfer roller to transfer the toner to the sheet, however it is no exaggeration to say that a portion where the transfer voltage works normally is the transfer nip portion. Therefore, a white portion (that is, a portion on which the toner is not deposited) on the surface (close to the photoreceptor) of the sheet at the transfer nip portion is electrically charged with a high potential. On this account, when the sheet is separated from the transfer nip portion, the separation discharge is generated between the white portion of the sheet and a high potential portion on the photoreceptor. Due to the separation discharge, some of the toner transferred to the sheet is reversely transferred to the photoreceptor. This causes the above-described deterioration in printing quality.

In front of the transfer nip portion, a sheet conveying roller, called an idle roller, is provided. The sheet conveying roller rotates at substantially the same peripheral velocity as the transfer roller. The idle roller rotates intermittently so that the sheet and the toner image on the photoreceptor are aligned with each other. The idle roller once stops rotating when the sheet has reached the idle roller, and then restarts rotating at such a timing that the toner image on the photoreceptor passes through the transfer nip portion. In this way, the idle roller conveys the sheet to the transfer nip.

As shown in FIGS. 9(*a*) to 9(*e*), a sheet P conveyed by an idle roller 116 is conveyed to a contact point of a transfer nip portion 127 in such a direction that the front edge of the sheet P proceeds toward an outer circumference of the photoreceptor 121. After the front edge of the sheet P first contacts with the photoreceptor 121, the sheet P is conveyed to the transfer nip portion 127 by the rotation of the photoreceptor 121.

If the front edge of the sheet P directly contacts with the contact point of the transfer nip portion 127, the sheet P vibrates at the moment of the front edge of the sheet P entering to the transfer nip portion 127. This vibration may cause a print slur (image deviation, transfer deviation) and/or a paper cockle at the front edge of the sheet P.

Further, in front of the transfer nip portion 127, a bended portion 128 of the sheet P is formed as shown in FIG. 9(*d*). The bended portion 128 is formed by substantially equalizing the peripheral velocity of the idle roller 116 and the peripheral velocity of a transfer roller 125. By forming the bended portion 128 in front of the transfer nip portion 127, the sheet P is conveyed to the transfer nip portion 127 in a state in which the sheet P surely sticks to the surface of the photoreceptor 121. Therefore, it is possible to prevent the problem in which, before the sheet P reaches the transfer nip portion 127, the sheet P sticks to the surface of the transfer roller 125 so as to be charged unnecessarily. Excessive charge to the sheet causes the above-described phenomenon of reversely transferring the toner.

By the bended portion 128 which intends to be flat, the sheet P is pushed in a direction in which the sheet P is conveyed. Therefore, the amount of the bended portion 128 is adjusted so that slipping of the sheet P is avoided by a nip pressure of the transfer nip portion 127.

Regarding the sheet conveying roller provided in front of the transfer nip portion, Japanese Unexamined Patent Publication No. 149265/2004 (Tokukai 2004-149265, published on May 27, 2004) discloses an image forming device capable of maintaining a certain speed difference between the running speed of a transcription belt and the speed of conveyance of a recording sheet conveyed by a resist roller corresponding to the sheet conveying roller, the speed difference being maintained irrespective of a change with time etc. of the performance of the resist roller.

According to this, the image forming device is structured so that the recording sheet conveyed by the resist roller is conveyed to image carriers for different colors by the transcription belt and the toner images on the image carriers are transcribed on the recording sheet, and the rotating speed of a resist motor is controlled so that the moving time of the recording sheet leading edge from one sensor to another installed between the resist roller and a suction roller and the moving time of the recording sheet trailing edge become predetermined values.

Moreover, in recent years, a particle diameter of the toner for visualizing the electrostatic latent image has been reduced due to an increase in resolution of the image information. Conventionally, the particle diameter of the toner is substantially in a range from 8 Φμm to 12 Φμm. However, in recent years, the particle diameter of the toner is substantially in a range from 4 Φμm to 7 Φμm. In the case of a small-particle toner used in recent years, even if large particles and fine particles are removed in a manufacturing step, crushing occurs due to friction at the time of frictional electrification that is the application of electric charge to the toner. Therefore, the toner whose particle diameter is 2 Φμm or less also contributes to an image development.

Conventionally, the image forming apparatus forcibly omits a signal corresponding to a sheet peripheral edge portion determined by the image forming apparatus, from an image signal supplied from a terminal device such as a host computer, so as to form a blank space.

If the above omission is not carried out in the case of recording on the entire sheet the image based on the image signal supplied from the terminal device, the toner corresponding to the sheet peripheral edge portion of the toner image on the photoreceptor is not transferred, and the toner remains on the photoreceptor. Then, the remaining toner scatters inside the image forming apparatus. This causes deterioration in image quality and/or a jam.

With regard to such a technique for forcibly forming the blank space, for example, Japanese Unexamined Patent Publication No. 101769/1991 (Tokukaihei 3-101769, published on Apr. 26, 1991) discloses a technique for separately changing the size of each blank space corresponding to each edge of a sheet when images are formed on the same sheet twice. Even if an error in a tolerance range occurs, an image can be prevented from sticking out, and it is possible to increase a region which can be utilized effectively for image formation.

Moreover, Japanese Unexamined Patent Publication No. 068874/1997 (Tokukaihei 9-068874, published on Mar. 11, 1997) discloses a technique in which, after a first test pattern (a solid image having a small blank space at a rear edge) is outputted and an image whose rear edge portion is blurred is obtained, a second test pattern having a normal blank space at a rear edge is outputted and the blank space at the rear edge is adjusted so as to correct the blur at the rear edge portion of the image. With this, it is possible to prevent the damage caused by the transfer charge (transfer electric field) to the image carrier (photoreceptor), and also possible to obtain the image of high quality.

However, since the particle diameter of the toner has been reduced these days, there occur problems which had not occurred in the past. That is, the problem is a phenomenon in which the rear edge of the image formed on the sheet moves backward, that is, the image is lengthened on the sheet. In a terrible case, the blank space provided at the sheet rear edge portion completely disappears. This phenomenon relates to a printing ratio on the sheet, and occurs in the case in which the printing ratio is high.

As a result of studies for finding out the cause of the above-described phenomenon, the present inventors found that the phenomenon is caused by a phenomenon in which the sheet slips with respect to the photoreceptor at the transfer nip portion. The present inventors further found that this slipping is caused by a combination of the following factors: (i) a decrease in particle diameter of the toner, (ii) the difference in peripheral velocity between the photoreceptor and the transfer roller and (iii) the bended portion formed in front of the transfer nip portion.

That is, in the case in which the amount of toner between the sheet and the photoreceptor is large, the absorptive power between the sheet and the photoreceptor decreases due to the decrease in particle diameter of the toner. Because of the decrease in the absorptive power, the nip pressure of the transfer nip portion cannot overcome the pushing power generated by the bended portion formed in front of the transfer nip portion. Therefore, the sheet moves in accordance with the peripheral velocity of the transfer roller. As a result, the sheet slips with respect to the photoreceptor.

The following will explain a mechanism of the decrease in the absorptive power between the sheet and the photoreceptor in reference to FIGS. 10(*a*) and 10(*b*). FIGS. 10(*a*) and 10(*b*) show the transfer nip portion where the toner image is transferred. A conventional large-particle toner T is used in FIG. 10(*a*), and a small-particle toner t of today is used in FIG. 10(*b*).

At the transfer nip portion 127, the photoreceptor 121 and the transfer roller 125 are compressed against each other via the toner (T, t) and a sheet P in this order when viewed from the photoreceptor 121, and a transfer voltage is applied by a transfer voltage applying section 129 through the transfer roller 125. The sheet P is conveyed in a sheet conveyance direction (indicated by an arrow X) by the rotational forces of the photoreceptor 121 and the transfer roller 125. Note that in FIGS. 10(*a*) and 10(*b*), an arrow Y indicates a rotation direction of the photoreceptor 121 and an arrow Z indicates a rotation direction of the transfer roller 125.

By applying the transfer electric field from the transfer roller 125 through the sheet P to the toner on the photoreceptor 121, the toner is absorbed by the sheet P. However, even in the case in which the thickness of a toner layer in FIG. 10(*a*) is the same as that in FIG. 10(*b*), an air layer in the toner layer made by the small-particle toner t is larger than an air layer in the toner layer made by the large-particle toner T.

Therefore, in the photoreceptor, the toner, the sheet and the transfer roller, the distance of propagation of the electric field is longer in the toner layer of the small-particle toner t than in the toner layer of the large-particle toner T. In the case in which the distance of propagation is long, the intensity of the electric field (electric field intensity) becomes low when the electric field propagates the toner layer and reaches the photoreceptor 121. As a result, the absorptive power between the sheet P and the photoreceptor 121 decreases.

Since the absorptive power between the sheet P and the photoreceptor decreases, the phenomenon of slipping of the sheet with respect to the photoreceptor occurs by the pushing power of the bended portion formed in front of the transfer nip portion. As a result, the phenomenon of backward movement of the rear edge of the image transferred to the sheet P occurs.

In the case in which the rear edge of the image moves backward and the blank space provided at the rear edge portion of the sheet completely disappears, there are problems in that the remaining toner on the photoreceptor causes printing stain when printing an image on the following sheet(s) and the printing quality (image quality) deteriorates because of no blank space. In addition to these, in a compact image forming apparatus which employs a switchback conveyance method and is capable of carrying out two-side printing, the sheet winds around a fixing roller and the jam occurs.

In the switchback conveyance method, a front edge and a rear edge reverse between when printing on a first surface and when printing on a second surface. That is, the rear edge portion of the first surface becomes the front edge portion of the second surface. In the case in which the blank space at the front edge portion disappears, the sheet is conveyed to a fixing process that is the next process of the transfer process and the unfixed toner is molten and fixed, the molten toner sticks to the fixing roller, the sheet winds around the fixing roller and the jam occurs.

This problem occurs since the particle diameter of the toner has been reduced. Therefore, this problem is a new problem which had not been considered in the past. Since the techniques disclosed in the above-described three Japanese Unexamined Patent Publications do not consider the problem, those techniques, of course, cannot solve the problem.

SUMMARY OF THE INVENTION

An object of the present invention is to provide an image forming apparatus which can avoid by a very simple way an occurrence of a phenomenon of slipping of a sheet with respect to a photoreceptor while suppressing a reduction in image quality as much as possible, and can surely secure a blank space at a rear edge portion of the sheet.

In order to achieve the above object, an image forming apparatus of the present invention forms on an electrostatic latent image bearing member an electrostatic latent image based on image information, visualizes the electrostatic latent image by a developer so as to obtain a visible image, and causes a transfer device to transfer the visible image to a recording material at a transfer nip portion while conveying the recording material, and the image forming apparatus includes: a recording material conveying roller section which is provided in front of the transfer nip portion and conveys the recording material to the transfer nip portion; and a roller section control section (roller section control means) for causing the recording material conveying roller section to rotate intermittently so that the sheet and the visible image are aligned with each other, and the roller section control means causes the recording material conveying roller section to stop when a front edge of the recording material reaches the transfer nip portion.

According to the above, in causing the recording material conveying roller section to rotate intermittently so that the recording material and the visible image formed on the electrostatic latent image bearing member are aligned with each other, the roller section control section causes the recording material conveying roller section to stop when the front edge of the recording material reaches the transfer nip portion. On this account, a bending (bended portion) of the recording material is not formed in front of the transfer nip portion, although the bending (bended portion) is one of factors for causing a slip phenomenon that is the phenomenon of slipping of the recording material with respect to the electrostatic latent image bearing member.

As a result, the slip phenomenon at the transfer nip portion does not occur, and it is possible to surely avoid the problems caused due to the reduction or disappearance of the blank space at the rear edge portion of the recording material. The problems are exemplified by (i) the printing stain caused by the remaining developer on the electrostatic latent image bearing member when printing an image on the following sheet(s), (ii) the deterioration in the printing quality (image quality) because of no blank space and (iii) the jam at the fixing section when carrying out the two-side printing adopting the switchback conveyance method.

The bended portion formed in front of the transfer nip portion is necessary for avoiding the phenomenon in which the developer is reversely transferred by the excessive charge to the recording material. Note that the recording material is excessively charged since the recording material sticks to the transfer device before the recording material reaches the transfer nip portion. However, the bended portion is becoming unnecessary since the particle diameter of the toner has been reduced these days. This is because, even if the bended portion is not formed as described above, it is possible to avoid the occurrence of the slip phenomenon by the very simple way (control) and also possible to solve the above-described problems caused due to the shortage of the blank space at the rear edge portion of the recording material even though the image quality may deteriorate a little.

Note that the present inventors had also thought of a configuration of avoiding the occurrence of the slip phenomenon by equalizing the peripheral velocity of the electrostatic latent image bearing member with the peripheral velocity of the transfer roller that is the transfer device. However, since a reduction in the printing quality due to the separation discharge generated when the recording material passes through the transfer nip portion is more significant than a reduction in the printing quality in the case of not forming the bended portion, the configuration of not forming the bended portion is adopted in the present invention.

Additional objects, features, and strengths of the present invention will be made clear by the description below. Further, the advantages of the present invention will be evident from the following explanation in reference to the drawings.

DESCRIPTION OF THE EMBODIMENTS

The following will explain one embodiment of the present invention in reference to FIGS. 1 to 8. Note that the present invention is not limited to this.

Figure 2:
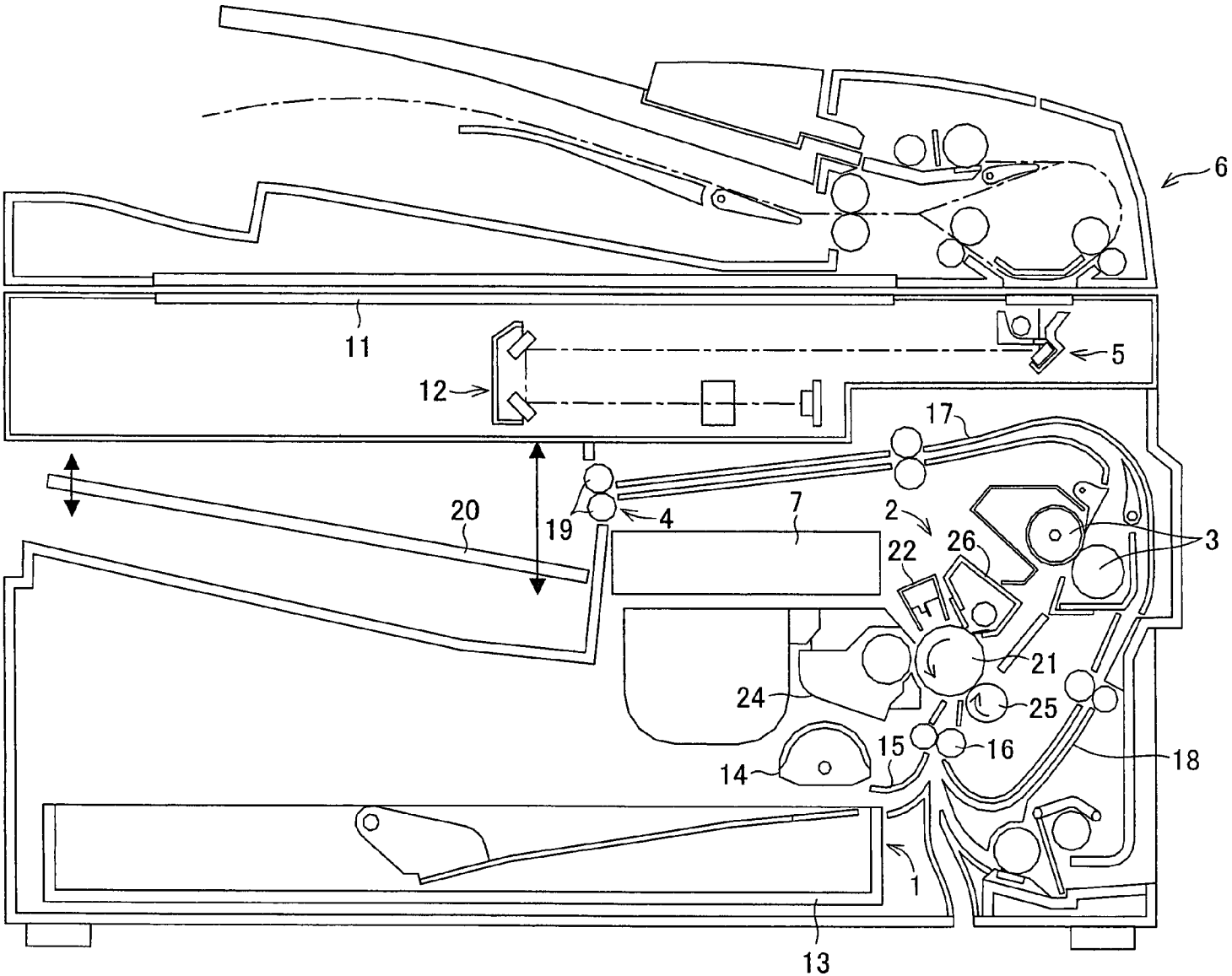
FIG. 2 is a vertical cross-sectional view showing an arrangement of the present image forming apparatus.
Figure 3:
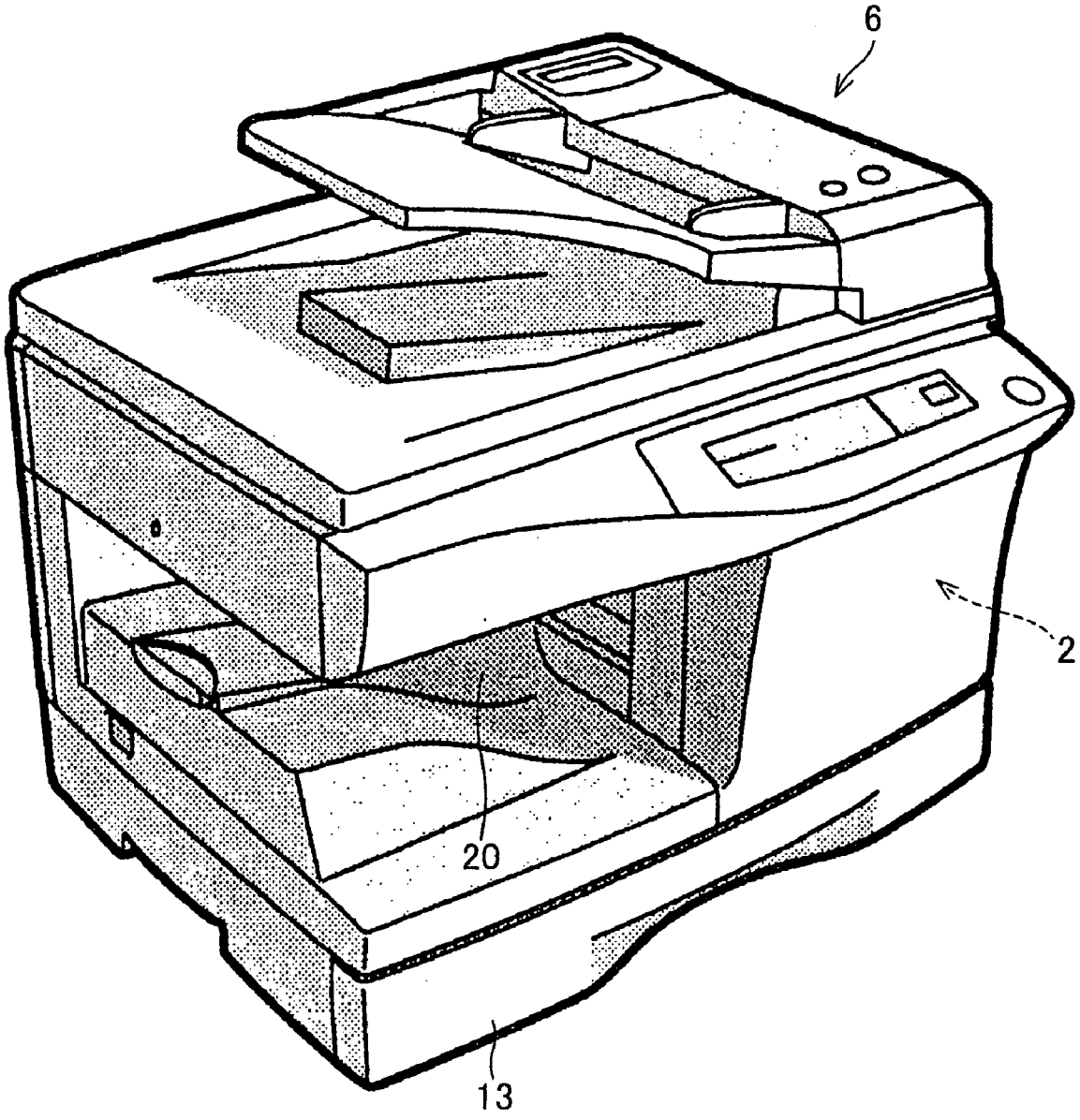
FIG. 3 is a perspective view showing an exterior of the present image forming apparatus.
Figure 4:
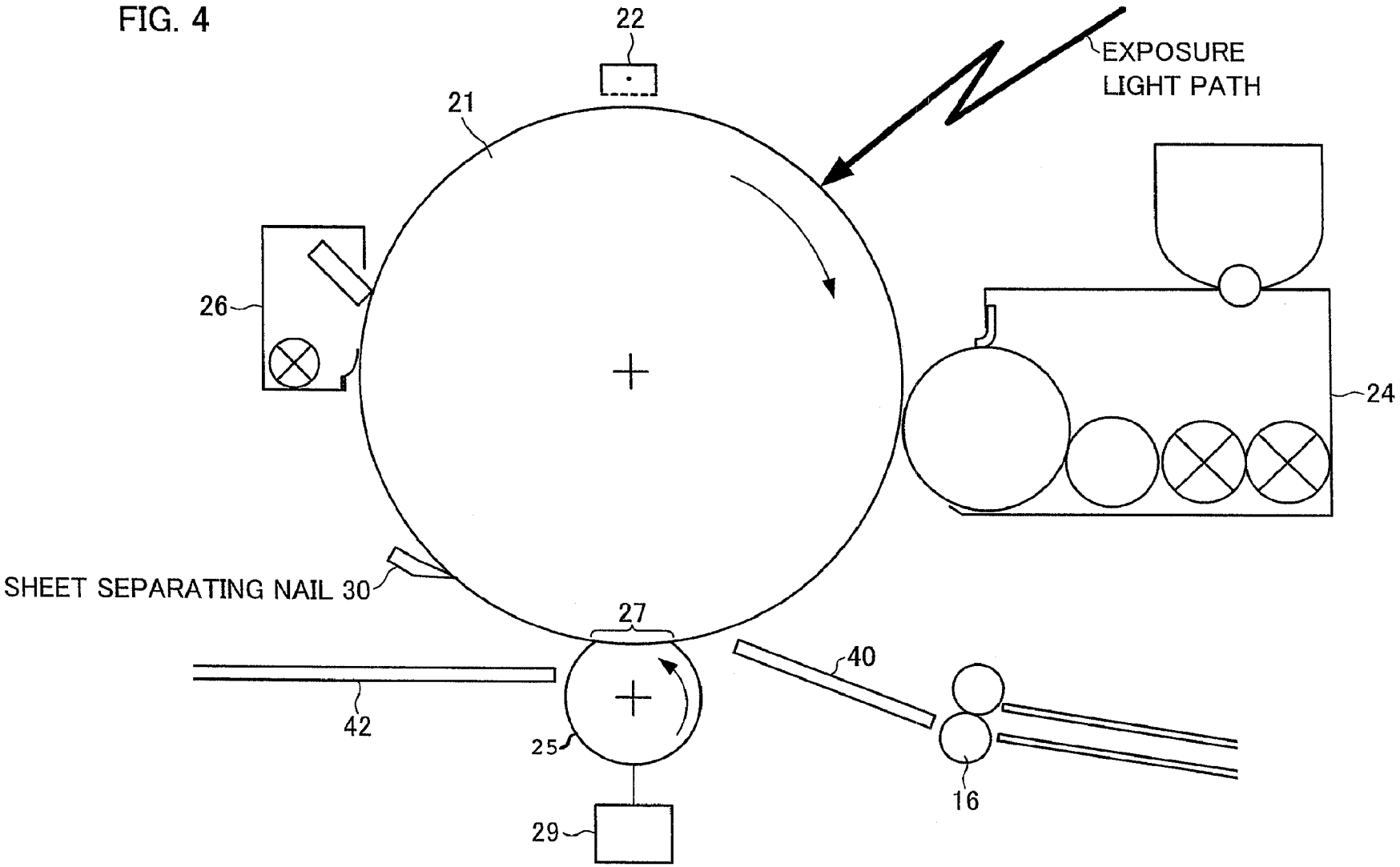
FIG. 4 is an explanatory diagram showing an arrangement of an image forming section of the present image forming apparatus.

As shown in FIG. 2 that is a vertical cross-sectional view, an image forming apparatus of the present embodiment includes, along a direction in which a sheet (recording material) is conveyed, a sheet feeding section 1, an image forming section 2, a fixing section 3 and a sheet ejecting section 4, and an image scanning section 5 is provided above these sections. Further, an automatic document conveying device 6 that is an option is provided above the image scanning section 5. FIG. 3 shows an exterior of the present image forming apparatus, and FIG. 4 shows an arrangement of the image forming section 2.

A document table 11 for mounting a document is provided near the image scanning section 5, and the automatic document conveying device 6 is provided above the document table 11 such that the automatic document conveying device 6 can be opened and closed. The automatic document conveying device 6 also functions as a document cover for preventing the mounted document from floating and for mounting the document in an appropriate place.

Image information of the document mounted on the document table 11 is read by an optical unit 12 provided under the document table 11. The image information read is subjected to an image processing by a control section 7, and is once stored in a memory (not shown) as the image information. Similarly, image information of a document conveyed by the automatic document conveying device 6 is read by the optical unit 12.

In the sheet feeding section 1, a sheet feeding cassette 13 is provided for housing sheets. The sheet in the sheet feeding cassette 13 is conveyed to a conveyance path 15 by the rotation of a sheet feeding roller 14. On the conveyance path 15 and in front of the image forming section 2, an idle roller (recording material conveying roller section) 16 is provided. The conveyance of the sheet once stops when the front edge of the sheet reaches the idle roller 16. The idle roller 16 stops in order that the front edge of an image transfer region on the sheet and the front edge of a toner image visualized on a photoreceptor 21 described later are aligned with each other.

The image forming section 2 forms on the sheet the toner image based on the image information. As shown in FIG. 4, the image forming section 2 includes the photoreceptor 21 that is in the shape of a cylinder. Further, the image forming section 2 includes, around the photoreceptor 21, a main charging device 22, a laser scanner unit (not shown), a developing device 24, a transfer roller (transfer section) 25, a sheet separating nail 30, a cleaning section 26, etc.

The main charging device 22 applies a certain voltage to the photoreceptor 21 to charge the surface of the photoreceptor 21 at a predetermined potential. The laser scanner unit reads out the image information from the memory of the control section 7, and exposes the photoreceptor 21 with laser light modulated by the image information, so as to form on the photoreceptor 21 an electrostatic latent image based on the image information.

The laser scanner unit forms the electrostatic latent image based on (i) the image information of the document mounted on the document table 11 and read by the image scanning section 5, (ii) the image information of the document which is moving by the auto document conveying device 6 and (iii) image information transmitted from each terminal device on a network (not shown) connected to the present image forming apparatus.

The toner (developer) in the developing device 24 is supplied from a developing roller to the surface of the photoreceptor 21. In this way, the electrostatic latent image formed on the photoreceptor 21 is visualized, that is, the electrostatic latent image becomes a toner image. This visualization is realized in such a manner that the toner is deposited on the surface of the photoreceptor 21 in accordance with a potential contrast of the electrostatic latent image on the photoreceptor 21. A developing bias is applied to the developing roller so that the toner is easily deposited on the photoreceptor 21.

The toner image on the photoreceptor 21 is conveyed toward the transfer roller 25 by the rotation of the photoreceptor 21. Moreover, the rotation of the idle roller 16 is restarted. In this way, the toner image is transferred at an appropriate position on the sheet when the sheet passes through the transfer nip portion 27 where the photoreceptor 21 and the transfer roller 25 are compressed against each other. The transfer voltage is applied from the transfer voltage applying section 29 through the transfer roller 25 to the transfer nip portion 27, and the sheet absorbs the toner by the transfer voltage. Then, the sheet is separated from the photoreceptor 21 by the sheet separating nail 30, and is conveyed to the fixing process by the rotational forces of the photoreceptor 21 and the transfer roller 25. Note that details of the transfer process will be described later.

The toner image transferred to the sheet is conveyed to the fixing section 3 in the next process. The toner image is molten and fixed on the sheet by the heat and pressure of the fixing section 3. Note that the fixing section 3 includes a heating roller and a pressure roller.

The sheet on which the toner image is fixed is conveyed in a conveyance path 17. In the case of the one-side printing, the sheet is ejected through a sheet ejecting roller 19 onto a sheet ejecting tray 20. In the case of the two-side printing, the rear edge portion of the sheet is held by the sheet ejecting roller 19 to once stop the sheet when the sheet passes through the sheet ejecting roller 19. Then, the sheet is conveyed from the conveyance path 17 to a sub conveyance path 18 by reversely rotating the sheet ejecting roller 19.

Such technique of reversely conveying the sheet is generally called a "switchback conveyance", and the sub conveyance path 18 is also referred to as a switchback conveyance path. After the sheet is reversely conveyed and its front surface and back surface are reversed, the sheet again reaches the idle roller 16. The toner image newly visualized by the image forming section 2 on the basis of the image information to be printed on the back surface (second surface) is transferred to and fixed on the back surface of the sheet. Then, the sheet is ejected through the conveyance path 17 and the sheet ejecting roller 19 onto the sheet ejecting tray 20.

Note that the foregoing description explains a general printing procedure of an electrophotographic printing method, and it is clear that a post-processing unit, a paper feeding unit having a plurality of stages for housing various types of sheets, and a paper ejecting tray having a plurality of bins for easily sorting ejected sheets are applicable to the present image forming apparatus to realize multifunction.

The following will explain in detail the transfer process in the present image forming apparatus.

Again, in the case of the present image forming apparatus, the peripheral velocity of the transfer roller 25 is higher than that of the photoreceptor 21 due to the above-described reason. Therefore, the sheet is pulled due to the difference in the peripheral velocity between the photoreceptor 21 and the transfer roller 25, so that the sheet is separated from the photoreceptor 21. Note that the peripheral velocity of the idle roller 16 is the same as that of the transfer roller 25. Moreover, the sheet conveyed from the idle roller 16 is conveyed to a contact point of the transfer nip portion 27 in such a direction that the front edge of the sheet proceeds toward an outer circumference of the photoreceptor 21. After the front edge of the sheet first contacts with the photoreceptor 21, the sheet is conveyed to the transfer nip portion 27 by the rotation of the photoreceptor 21.

Figure 9:
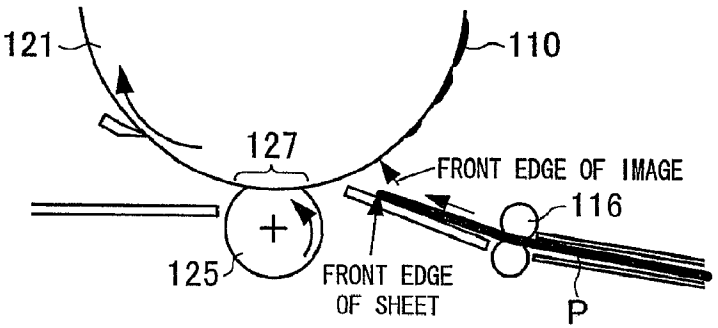
FIGS. 9(*a*) to 9(*e*) are explanatory diagrams showing how a sheet is conveyed to the transfer nip portion of the conventional image forming apparatus.
Figure 9:
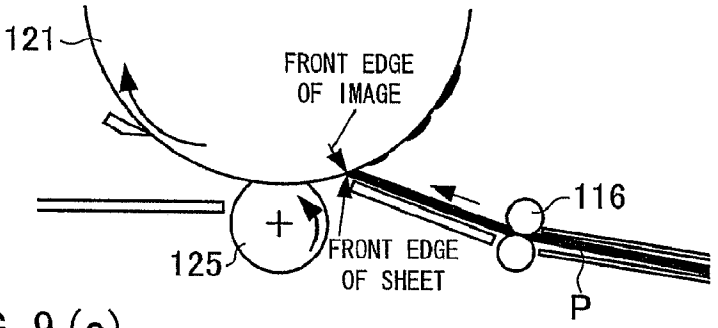
Figure 9:
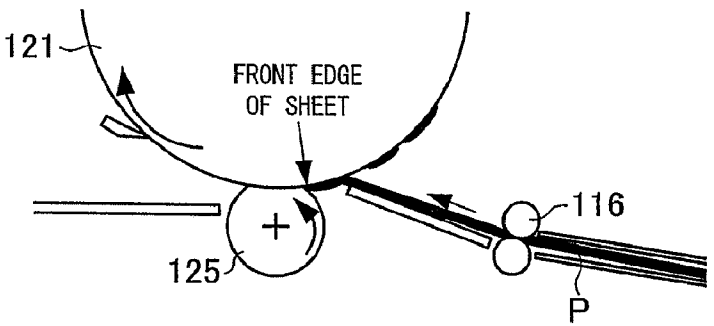
Figure 9:
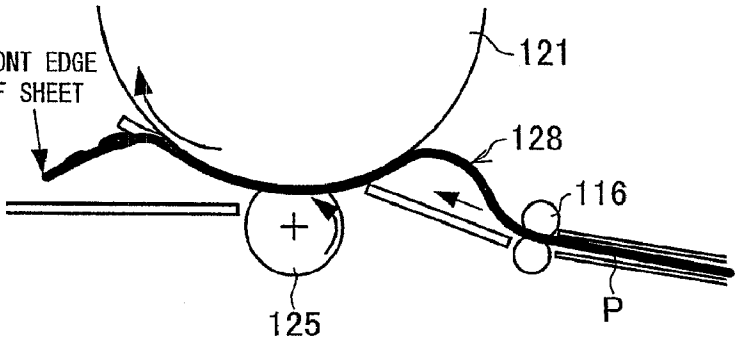
Figure 9:
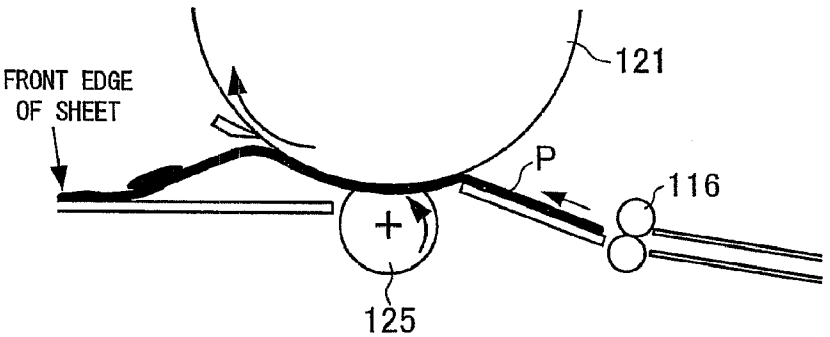
Figure 10:
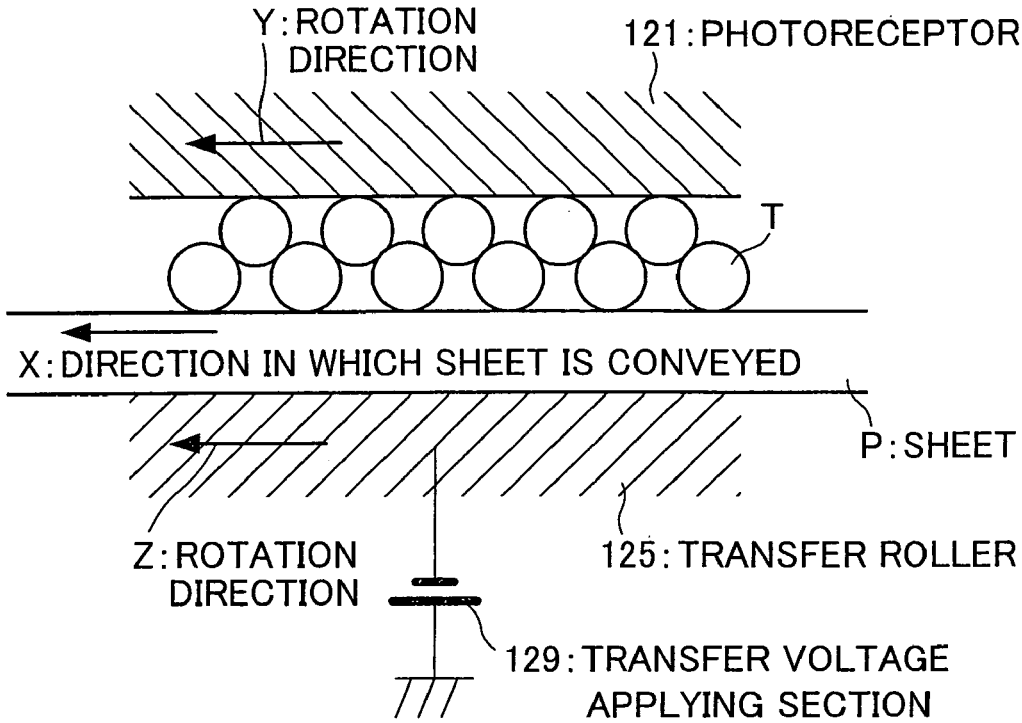
FIGS. 10(*a*) and 10(*b*) are explanatory diagrams showing a mechanism of a decrease in an absorptive power between a photoreceptor and a sheet, and the decrease is caused due to a decrease in particle diameter of a toner.
Figure 10:
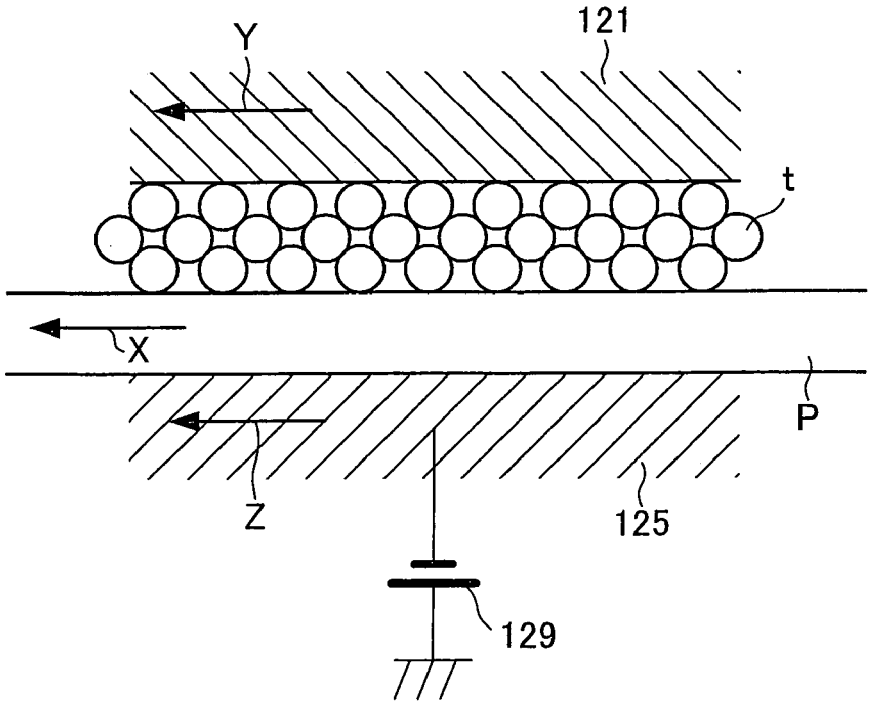

In the case in which the peripheral velocity of the photoreceptor 21 is V1 (mm/sec), the peripheral velocity of the transfer roller 25 is V2 (mm/sec) and the peripheral velocity of the idle roller 16 is V3 (mm/sec) in the present image forming apparatus, these V1, V2 and V3 are designed so as to satisfy $V1<V2\approx V3$ (that is, $V1<V2=V3$ (V3 ranged from $0.99\times V2$ to $1.012\times V2$)). More specifically, these V1, V2, and V3 are designed so as to satisfy $V1\times 1.005\leqq V2\approx V3\leqq V1\times 1.03$. By setting each peripheral velocity as above, it is possible to avoid the phenomenon in which the developer is reversely transferred at the time of separation of the sheet from the photoreceptor 21, without pulling the sheet too strongly (too quickly) when the sheet is separated from the photoreceptor 21. In addition to this, it is also possible to appropriately adjust the size of the bended portion 128 (see FIG. 9(*d*)) formed in the case of controlling the rotation of the idle roller 16 in the same manner as with the conventional timings.

However, as previously described, in the image forming apparatus in which the bended portion of the sheet is formed in front of the transfer nip portion and the peripheral velocity of the transfer roller 25 is a bit higher than the peripheral velocity of the photoreceptor 21, in the case in which a large amount of toner is between the photoreceptor 21 and the sheet due to the reduction in the particle diameter of the toner, the sheet slips with respect to the photoreceptor 21, that is, a slip phenomenon occurs. If such slip phenomenon occurs, the rear edge of the toner image transferred onto the sheet moves backward. Thus, the blank space provided at the rear edge portion of the sheet reduces or disappears. Therefore, the toner remaining on the photoreceptor 21 causes stain, and the printing quality (image quality) deteriorates because of no blank space. In addition to these, in the case of the present image forming apparatus adopting the switchback conveyance method, there are problems in that for example, when printing onto the second surface for the two-side printing, the jam occurs at the fixing section 3.

In order to prevent the reduction or disappearance of the blank space at the rear edge portion of the sheet, the following countermeasures are taken in the present image forming apparatus. That is, in the case in which the roller section control section for controlling the rotation of the idle roller 16 causes the idle roller 16 to rotate intermittently so that the sheet and the toner image on the photoreceptor 21 are aligned with each other, a stop timing of the idle roller 16 is changed. That is, conventionally, the idle roller 16 is stopped after the rear edge of the sheet has passed through the idle roller 16. However, the stop timing of the idle roller 16 is accelerated so that the idle roller 16 is stopped when the front edge of the sheet reaches the transfer nip portion 27.

Thus, the rotation of the idle roller 16 stops when the front edge of the sheet reaches the transfer nip portion 27. Therefore, the bended portion of the sheet is not formed in front of the transfer nip portion, although the bended portion is one of factors for causing the slip phenomenon that is the phenomenon of slipping of the sheet with respect to the photoreceptor 21. On this account, the slip phenomenon does not occur. As a result, the blank space at the rear edge portion of the sheet is surely secured, and it is possible to appropriately avoid the above-described problems caused due to the reduction or disappearance of the blank space at the rear edge portion of the sheet.

In the case of stopping the rotation of the idle roller 16 before the rear edge of the sheet finishes passing through the idle roller 16, the sheet passes through the idle roller 16 by a conveyance power of the transfer nip portion. Therefore, a load is given to the idle roller 16. Such load lowers the conveyance power of the sheet, and becomes a factor for causing the transfer deviation, etc.

Here, in order to reduce the load, the present image forming apparatus is arranged so that the idle roller 16 includes a pair of rollers that are a driving roller and a driven roller. With this arrangement, it is possible to avoid an excessive increase in the load.

Figure 1:
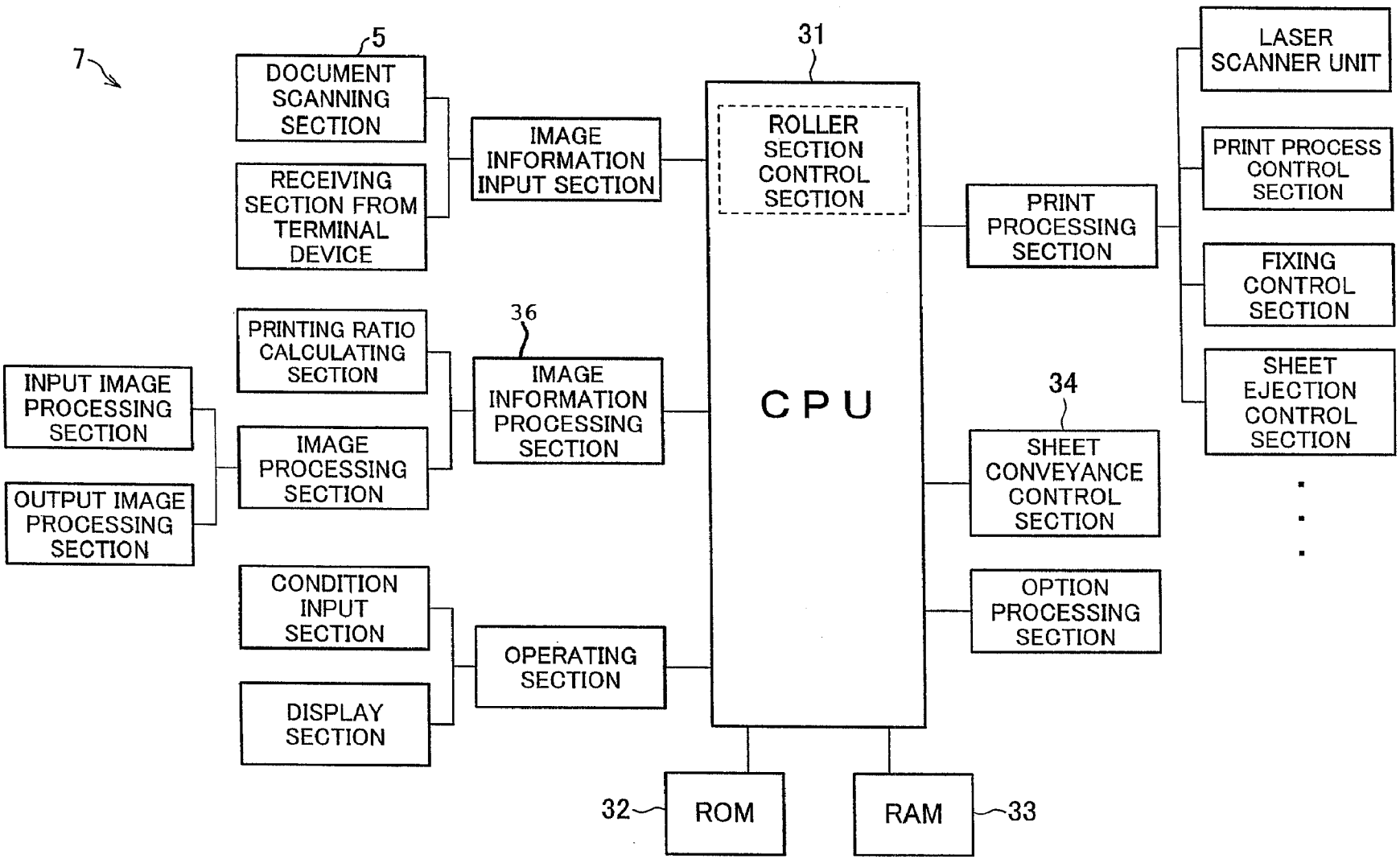
FIG. 1 shows one embodiment of the present invention and is a block diagram showing an arrangement of a control section of an image forming apparatus.

Incidentally, the roller section control section (roller section control means) is realized by a CPU 31, a ROM 32 and a RAM 33 which are included in the control section 7 shown in FIG. 1. The following will explain the control section 7 of the present image forming apparatus in reference to FIG. 1. FIG. 1 is a block diagram showing an arrangement of the control section 7 of the present image forming apparatus.

The CPU 31 is a brain for controlling all the operations of the image forming apparatus. That is, the CPU 31 receives from an image information input section the image information transmitted from the terminal device and/or the image information read by the image scanning section 5. Then, the CPU 31 causes the image information processing section 36 to process the image information in accordance with instructions, such as a print condition, a print request, etc., supplied from an operating section, such as a condition input section, a display section, etc.

Then, the CPU 31 supplies the processed image information to a print processing section. Then, the CPU 31 controls the laser scanner unit, a print process control section for controlling the image forming section 2, a fixing control section for controlling the fixing section 3, a sheet ejection control section for controlling the sheet ejecting section 4, etc., and also causes a sheet conveyance control section 34 to control a sheet conveying system, such as the sheet feeding section 1, the idle roller 16, etc. In this way, the image is formed on the sheet P having a predetermined size instructed. Moreover, the CPU 31 also causes an option processing section to control an option device, such as the automatic document conveying device 6, etc.

The image information processing section includes, as an image processing section, (i) an input image processing section for carrying out a predetermined image processing with respect to the image information supplied through the image information input section and (ii) an output image processing section for carrying out a predetermined image processing with respect to image data, processed by the input image processing section, so as to obtain output image data for forming a write image outputted to the print processing section.

In the present image forming apparatus, when the CPU 31 controls the rotation of the idle roller 16 by way of the sheet conveyance control section 34, the idle roller 16 is conventionally stopped after the rear edge of the sheet has passed through the idle roller 16, however the stop timing of the idle roller 16 is accelerated so that the idle roller 16 is stopped when the front edge of the sheet reaches the transfer nip portion 27.

Moreover, on the basis of an elapsed time since the restart of the rotation of the idle roller 16, the CPU 31 detects whether the front edge of the sheet has reached the transfer nip portion 27 or not. As described above, in order that the sheet and the toner image on the photoreceptor 21 are aligned with each other, the rotation of the idle roller 16 is once stopped when the front edge of the sheet reaches the idle roller 16 and the rotation of the idle roller 16 is restarted at such a timing that the toner image on the photoreceptor 21 passes through the transfer nip portion 27. Therefore, on the basis of the elapsed time since the restart of the rotation of the idle roller 16 which is restarted rotating so that the sheet is conveyed to the transfer nip portion 27, it is possible to judge whether the front edge of the sheet has reached the transfer nip portion 27 or not. In the case of this detection method, it is possible to detect whether the front edge of the sheet has reached the transfer nip portion 27 or not by a configuration whose number of members (sections) is smaller than the number of members in a configuration of additionally including a sensor, etc. for detecting whether the front edge of the sheet has passed through the transfer nip portion 27 or not.

The ROM 32 includes the function of the roller section control section, and stores various programs used by the CPU 31 for causing the present image forming apparatus to function and data, such as the number of steps of a motor, etc. The RAM 33 is a storage section (memory) used by the CPU 31.

Figure 5:
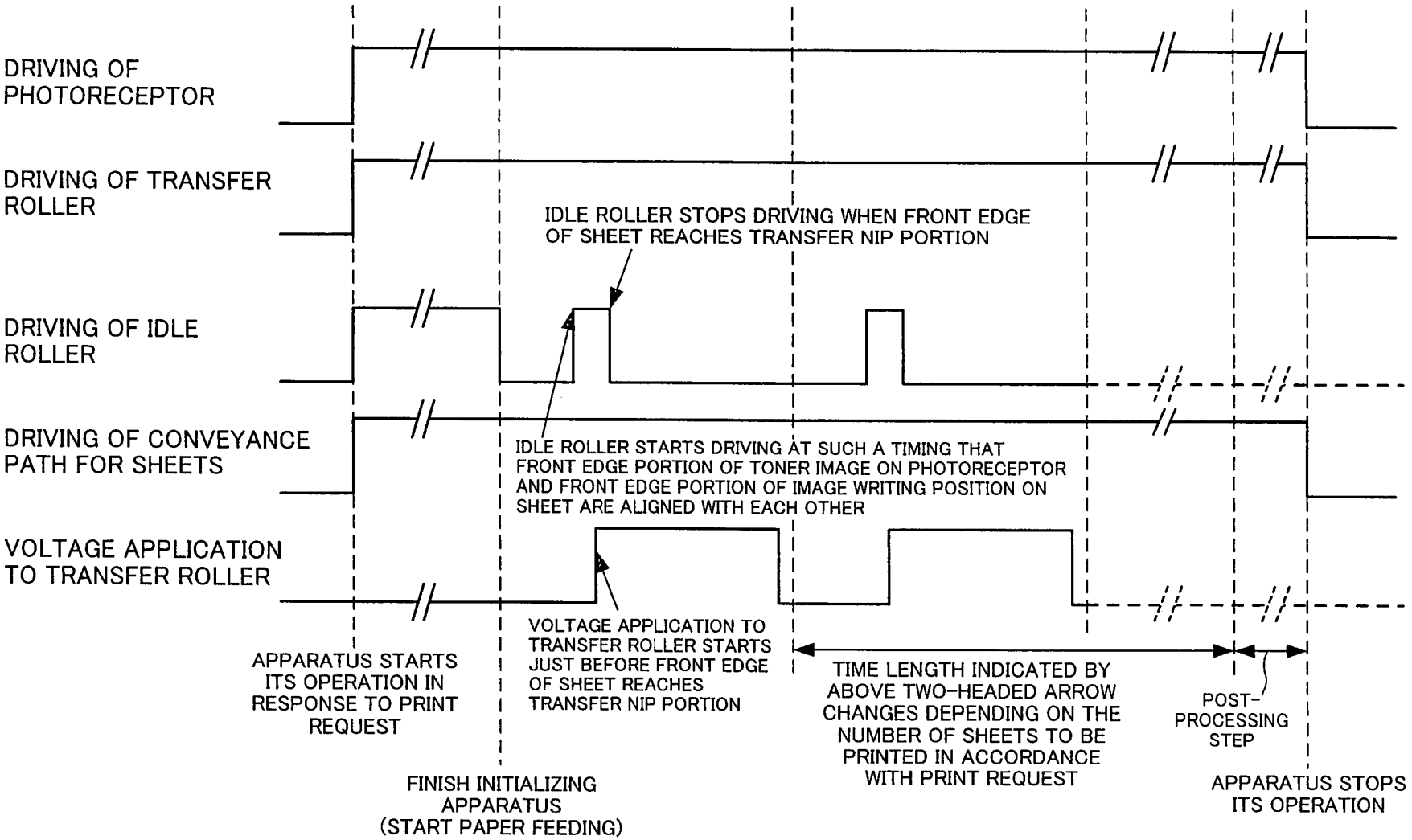
FIG. 5 is a timing chart showing timings of driving of a photoreceptor, a transfer nip portion, an idle roller and a conveyance path for sheets, and a timing of a voltage application to a transfer roller, in the present image forming apparatus.
Figure 6:
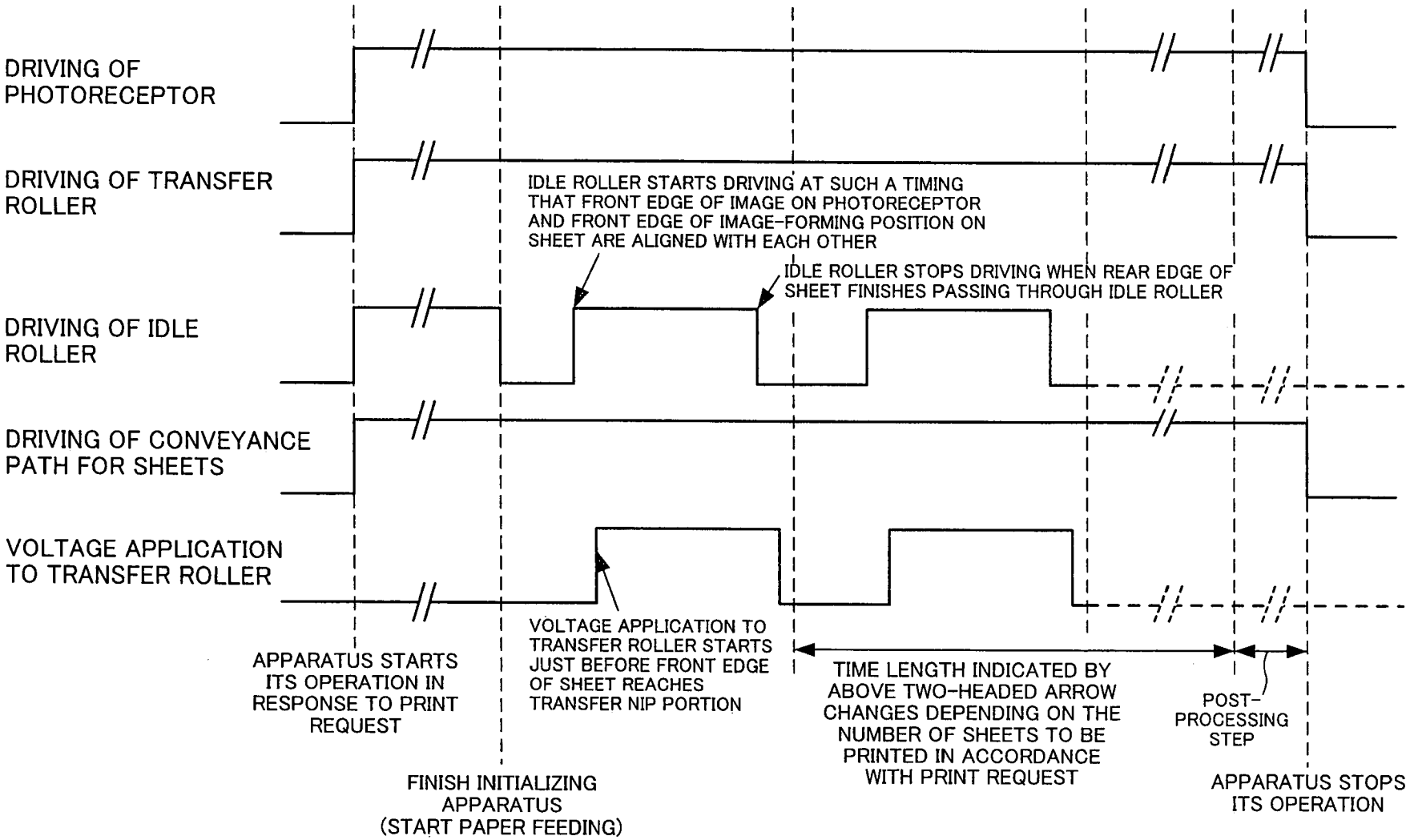
FIG. 6 is a timing chart showing timings of driving of a photoreceptor, a transfer nip portion, an idle roller and a conveyance path for sheets, and a timing of a voltage application to a transfer roller, in a conventional image forming apparatus.

FIG. 5 shows timings of driving of the photoreceptor 21, the transfer nip portion 27, the idle roller 16 and a conveyance path for sheets, and a timing of a voltage application to the transfer roller 25, in the present image forming apparatus. Moreover, FIG. 6 shows timings of driving of a photoreceptor, a transfer nip portion, an idle roller and a conveyance path for sheets, and a timing of a voltage application to a transfer roller, in a conventional image forming apparatus.

The timing of the start (restart) of the rotation of the idle roller 16 is the same between the present image forming apparatus and the conventional image forming apparatus, and is such a timing that a front edge portion of the toner image on the photoreceptor 21 and a front edge of an image writing position on the sheet are aligned with each other. Note that the image writing position is a position in which an image is written.

Meanwhile, the timing of the stop of the rotation of the idle roller 16 is different between the present image forming apparatus and the conventional image forming apparatus. That is, in the conventional image forming apparatus, the timing of the stop is such a timing that the rear edge of the sheet finishes passing through the idle roller 16, while in the present image forming apparatus, the timing of the stop is such a timing that the front edge of the sheet has reached the transfer nip portion 27.

As long as the bended portion that may cause a problem is not formed, the timing of the stop of the rotation of the idle roller 16 does not have to be such a timing that the front edge of the sheet has reached the transfer nip portion 27. That is, the timing of the stop can be any timing as long as the sheet is held by the transfer nip portion 27 so that the sheet can be conveyed, without the conveyance power of the idle roller 16, by the conveyance power of the transfer nip portion 27.

Figure 7:
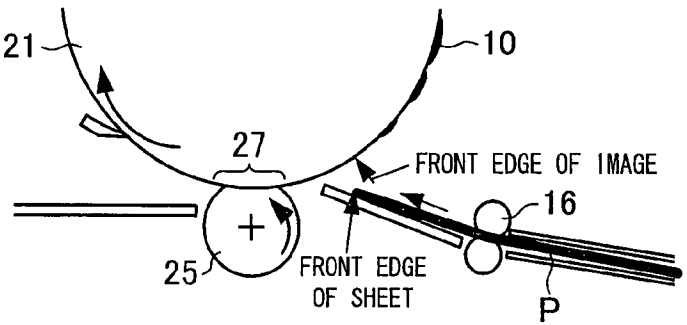
FIGS. 7(*a*) to 7(*e*) are explanatory diagrams showing how a sheet is conveyed to a transfer nip portion of the present image forming apparatus.
Figure 7:
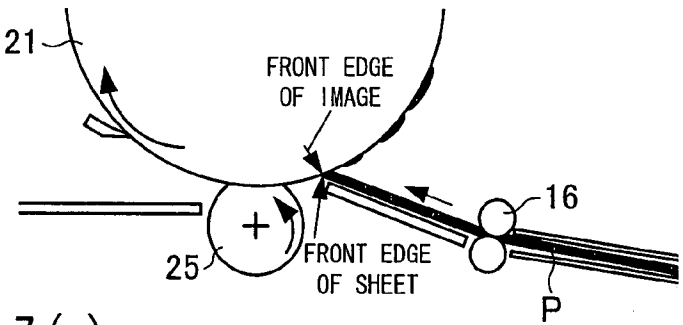
Figure 7:
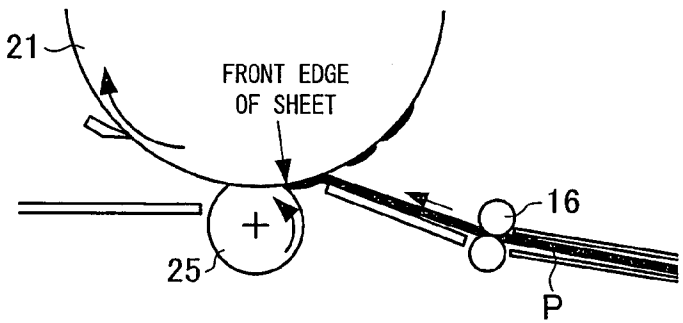
Figure 7:
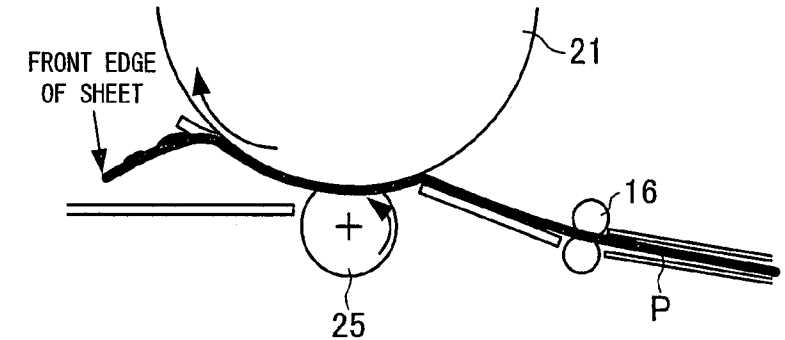
Figure 7:
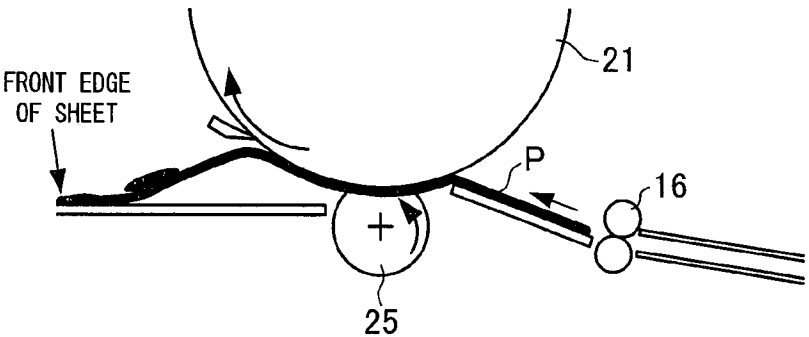

FIGS. 7(*a*) to 7(*e*) show how the sheet P is conveyed to the transfer nip portion 27 in the present image forming apparatus. The toner image 10 formed on the photoreceptor 21 is conveyed to the transfer nip portion 27 by the rotation of the photoreceptor 21, and the sheet P is conveyed to the transfer nip portion 27 by the rotation of the idle roller 16. The sheet P conveyed from the idle roller 16 is conveyed to the contact point of the transfer nip portion 27 by the guidance of a paper guide 40 in such a direction that the front edge of the sheet P proceeds toward the outer circumference of the photoreceptor 21. Therefore, the sheet P first contacts with the photoreceptor 21. Then, the sheet P is guided to the transfer nip portion 27 by the rotation of the photoreceptor 21. The sheet P and the photoreceptor 21 contact with each other so that the front edge of the toner image 10 and the front edge of a region where on the sheet P the image is formed (that is, the front edge of a region obtained by omitting from the entire region of the sheet a blank space provided at the front edge portion) are aligned with each other by controlling the timing of the restart of the rotation of the idle roller 16.

When the front edge of the sheet P reaches the transfer nip portion 27, the rotation of the idle roller 16 is stopped, and the sheet P is conveyed by the conveyance power of the transfer nip portion 27. Since the rotation of the idle roller 16 is stopped, the sheet P does not bend in front of the transfer nip portion 27, that is, the bended portion is not formed. The front edge of the sheet P on which the toner image 10 is formed when the sheet P has passed through the transfer nip portion 27 is separated from the photoreceptor 21 by the sheet separating nail 30, and the sheet P is conveyed along a paper guide 41.

Figure 8:
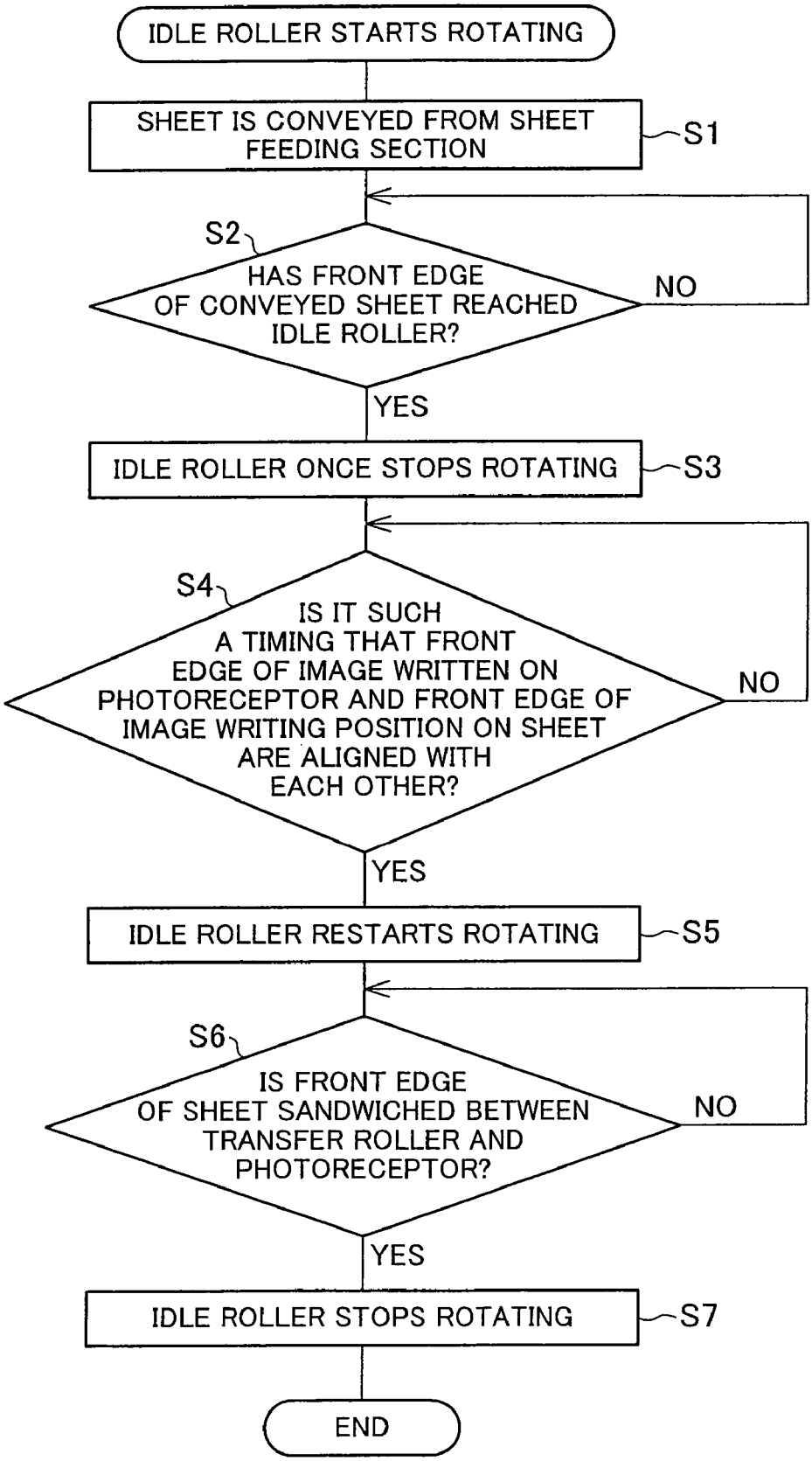
FIG. 8 is a flow chart showing a control procedure of the rotation of the idle roller in the present image forming apparatus.

In reference to a flow chart of FIG. 8, the following will explain the rotation of the idle roller 16 at the time of an image-forming operation carried out by the present image forming apparatus arranged as above.

First, the sheet P is conveyed from the sheet feeding section 1 (S1), and then the CPU 31 judges whether or not the front edge of the sheet P conveyed has reached the idle roller 16 (S2). In the case in which the CPU 31 judges that the front edge of the sheet P has reached the idle roller 16, the CPU 31 once stops the rotation of the idle roller 16 (S3).

Then, the CPU 31 judges whether or not it is such a timing that the front edge of the toner image 10 formed by developing the electrostatic latent image formed on the photoreceptor 21 and the front edge of the image writing position on the sheet P are aligned with each other (S4). In the case in which the CPU 31 judges that it is the timing, the CPU 31 restarts the rotation of the idle roller 16 (S5). Thus, the conveyance of the sheet P which has been stopped at the idle roller 16 is restarted, and the front edge of the sheet P is guided to the transfer nip portion 27.

Next, the CPU 31 judges whether or not the front edge of the sheet P has reached the transfer nip portion 27, that is, whether or not the front edge of the sheet P is sandwiched between the transfer roller 25 and the photoreceptor 21 (S6). In the case in which the CPU 31 judges that the front edge of the sheet P is sandwiched between the transfer roller 25 and the photoreceptor 21, the CPU 31 stops the rotation of the idle roller 16 (S7).

As above, in order to avoid the occurrence of an image elongation that is a phenomenon in which the image is lengthened on the sheet P due to the slipping of the sheet P, the present image forming apparatus is arranged so that the timing of the stop of the idle roller 16 is accelerated and the sheet P is not bended in front of the transfer nip portion 27 since the bended portion causes the slip phenomenon causing the image elongation. Therefore, it is possible to (i) avoid by a very simple way the occurrence of the slip phenomenon that is the phenomenon of slipping of the sheet P with respect to the photoreceptor 21 while suppressing the reduction in image quality as much as possible, (ii) surely secure the blank space formed at the rear edge portion of the sheet and (iii) appropriately avoid the above-described problems caused due to the reduction or disappearance of the blank space.

Note that the roller section control section in the image forming apparatus may be realized by a hardware logic or, as described in the present embodiment, a software using a CPU.

That is, the present image forming apparatus includes: a CPU (central processing unit) which executes a command of a control program for realizing a function of the roller section control section; a ROM (read only memory) which stores the program; a RAM (random access memory) which loads the program; a storage device (recording medium), such as a memory, which stores the program and various data; and the like. Then, the image forming apparatus can be realized by supplying a computer-readable recording medium to an image scanner apparatus and then causing its computer (CPU, MPU, or the like) to read out and execute a program code recorded in the recording medium. Note that the computer-readable recording medium records therein the program code (executable format program, intermediate code program, source program) of the control program which realizes the above-described functions. In this case, the program code itself read out from the recording medium realizes the above-described functions, and the recording medium recording the program code is included in the present invention.

Thus, in the present specification, section (means) does not necessarily mean a physical means, that is, the function(s) of each section (means) may be realized by software. Moreover, the function(s) of a single means may be realized by two physical means or more, and the functions of two means or more may be realized by a single physical means.

Note that in the present embodiment, the recording medium may be a memory (not shown) for process steps on a microcomputer. For example, the program medium may be something like a ROM. Alternatively, the program medium may be such that a program reader device (not shown) as an external storage device may be provided in which a storage medium is inserted for reading.

In any case, the stored program may be executable on access by a microprocessor. Further, the program may be retrieved, and the retrieved program may be downloaded to a program storage area (not shown) in a microcomputer to execute the program. The download program is stored in a main body device in advance.

The program medium may be a recording medium constructed separably from a main body. The medium may be (i) tape based, such as a magnetic tape or cassette tape, (ii) disc based, such as a magnetic disc (floppy disc, hard disk, etc.) and an optical disc (CD-ROM, MO, MD, DVD, etc.), (iii) card based, such as an IC card (including a memory card) and an optical card, (iv) or a semiconductor memory, such as a mask ROM, EPROM (Erasable Programmable Read Only Memory), EEPROM (Electrically Erasable Programmable Read Only Memory), and a flash ROM. All these types of media hold the program in a fixed manner.

Moreover, in the present embodiment, since the system is arranged to connect to the Internet or another communication network, the medium may be a storage medium which holds the program in a flowing manner so that the program can be downloaded over the communication network. Note that if the program is downloaded over a communication network in this manner, the download program may be stored in a main body device in advance or installed from another recording medium.

As above, an image forming apparatus of the present invention forms on an electrostatic latent image bearing member an electrostatic latent image based on image information, visualizes the electrostatic latent image by a developer so as to obtain a visible image, and causes a transfer device to transfer the visible image to a recording material at a transfer nip portion while conveying the recording material, and the image forming apparatus includes: a recording material conveying roller section which is provided in front of the transfer nip portion and conveys the recording material to the transfer nip portion; and roller section control means for causing the recording material conveying roller section to rotate intermittently so that the sheet and the visible image are aligned with each other, and the roller section control means causes the recording material conveying roller section to stop when a front edge of the recording material reaches the transfer nip portion.

According to the above, in causing the recording material conveying roller section to rotate intermittently so that the recording material and the visible image formed on the electrostatic latent image bearing member are aligned with each other, the roller section control means causes the recording material conveying roller section to stop when the front edge of the recording material reaches the transfer nip portion. On this account, a bending (bended portion) of the recording material is not formed in front of the transfer nip portion, although the bending (bended portion) is one of factors for causing the slip phenomenon that is the phenomenon of slipping of the recording material with respect to the electrostatic latent image bearing member.

As a result, the slip phenomenon at the transfer nip portion does not occur, and it is possible to surely avoid the problems caused due to the reduction or disappearance of the blank space at the rear edge portion of the recording material. The problems are exemplified by (i) the printing stain caused by the remaining developer on the electrostatic latent image bearing member when printing an image on the following sheet(s), (ii) the deterioration in the printing quality (image quality) because of no blank space and (iii) the jam at the fixing section when carrying out the two-side printing adopting the switchback conveyance method.

The bended portion formed in front of the transfer nip portion is necessary for avoiding the phenomenon in which the developer is reversely transferred by the excessive charge to the recording material. Note that the recording material is excessively charged since the recording material sticks to the transfer device before the recording material reaches the transfer nip portion. However, the bended portion is becoming unnecessary since the particle diameter of the toner has been reduced these days. This is because, even if the bended portion is not formed as described above, it is possible to avoid the occurrence of the slip phenomenon by the very simple way (control) and also possible to solve the above-described problems caused due to the shortage of the blank space at the rear edge portion of the recording material even though the image quality may deteriorate a little.

Note that the present inventors had also thought of a configuration of avoiding the occurrence of the slip phenomenon by equalizing the peripheral velocity of the electrostatic latent image bearing member with the peripheral velocity of the transfer roller that is the transfer device. However, since a reduction in the printing quality due to the separation discharge generated when the recording material passes through the transfer nip portion is more significant than a reduction in the printing quality in the case of not forming the bended portion, the configuration of not forming the bended portion is adopted in the present invention.

It is appropriate that the image forming apparatus be configured such that the transfer device includes the transfer roller which is provided in such a manner as to be compressed against the electrostatic latent image bearing member via the recording material, and an electric field whose polarity is opposite to a polarity of an electric charge of the developer is applied to the transfer roller. Moreover, it is appropriate that $V1<V2\approx V3$ (that is $V1<V2=V3$ ($V3$ ranges from $0.99\times V2$ to $1.012\times V2$)), where $V1$ (mm/sec) is a peripheral velocity of the electrostatic latent image bearing member, $V2$ (mm/sec) is a peripheral velocity of the transfer roller and $V3$ (mm/sec) is a peripheral velocity of a recording material conveying roller provided in front of the transfer nip portion. Further, it is appropriate that $V1\times1.005\leqq V2\approx V3\leqq V1\times1.03$.

That is, the phenomenon of slipping of the recording material with respect to the electrostatic latent image bearing member easily occurs in the case in which the configuration of the transfer device, and the peripheral velocities of the electrostatic latent image bearing member, the transfer roller and the recording material conveying roller are as above. Therefore, in such a case, it is more effective to adopt the present invention. Further, it is appropriate that the present invention be applied to a case in which the average particle diameter of a developer to be used is equal to or less than 7 Φμm (the diameter of the large particle is less than 10 Φμm).

The image forming apparatus may be configured so that the recording material conveying roller section includes a pair of rollers that are the driving roller and the driven roller.

In the case in which the recording material conveying roller section stops its driving, the recording material passes through the recording material conveying roller section by the conveyance power of the transfer nip portion. Therefore, the load increases at the recording material conveying roller section, and such load lowers the conveyance power of the sheet, and becomes a factor for causing the transfer deviation, etc. However, by using the recording material conveying roller section including a pair of rollers that are the driving roller and the driven roller, it is possible to avoid an excessive increase in the load.

Further, the image forming apparatus may be configured so that, on the basis of an elapsed time since the restart of the rotation of the recording material conveying roller section, the roller section control means detects whether or not the front edge of the recording material has reached the transfer nip portion.

The recording material conveying roller section rotates intermittently so that the recording material and the visible image on the electrostatic latent image bearing member are aligned with each other. The recording material conveying roller section once stops to stop the recording material when the recording material reaches the recording material conveying roller section. The recording material conveying roller section restarts rotating at such a timing that the visible image on the electrostatic latent image passes through the transfer nip portion. Thus, the recording material is conveyed to the transfer nip portion. Therefore, on the basis of the elapsed time since the restart of the rotation of the recording material conveying roller section, it is possible to judge whether or not the front edge of the recording material has reached the transfer nip portion.

Therefore, it is possible to detect whether the front edge of the recording material has reached the transfer nip portion or not by the configuration whose number of members (sections) is smaller than the number of members in the configuration of additionally including the sensor, etc. for detecting whether the front edge of the recording material has passed through the transfer nip portion or not.

As above, a program for controlling the image forming apparatus of the present invention is a control program which causes a computer to execute the roller section control means in the image forming apparatus of the present invention. Therefore, it is possible to cause a computer to realize the present image forming apparatus capable of appropriately avoiding by the simple way the problems caused due to the reduction or disappearance of the blank space at the rear edge portion of the recording material. The problems are exemplified by (i) the printing stain caused by the remaining developer on the electrostatic latent image bearing member when printing an image on the following sheet(s), (ii) the deterioration in the printing quality (image quality) because of no blank space and (iii) the jam at the fixing section when carrying out the two-side printing adopting the switchback conveyance method. On this account, the image forming apparatus can be general-purpose.

As above, a recording medium of the present invention is a computer-readable recording medium recording the control program of the image forming apparatus of the present invention. Therefore, it is possible to easily supply to a computer the control program of the image forming apparatus of the present invention which can appropriately avoid by the simple way the problems caused due to the reduction or disappearance of the blank space at the rear edge portion of the recording material. The problems are exemplified by (i) the printing stain caused by the remaining developer on the electrostatic latent image bearing member when printing an image on the following sheet(s), (ii) the deterioration in the printing quality (image quality) because of no blank space and (iii) the jam at the fixing section when carrying out the two-side printing adopting the switchback conveyance method.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming apparatus which forms on an electrostatic latent image bearing member an electrostatic latent image based on image information, visualizes the electrostatic latent image by a developer so as to obtain a visible image, and causes a transfer device to transfer the visible image to a recording material at a transfer nip portion while conveying the recording material, the image forming apparatus comprising:

a recording material conveying roller section which is provided in front of the transfer nip portion and conveys the recording material to the transfer nip portion; and roller section control means for causing the recording material conveying roller section to rotate intermittently so that the recording material and the visible image are aligned with each other, wherein said roller section control means causes the recording material conveying roller section to stop driving when a front edge of the recording material reaches the transfer nip portion, wherein $V1<V2$, $V1<V3$, $V2\approx V3$, where V1 (mm/sec) is a peripheral velocity of the electrostatic latent image bearing member, V2 (mm/sec) is a peripheral velocity of the transfer roller and V3 (mm/sec) is a peripheral velocity of the recording material conveying roller section provided in front of the transfer nip portion after said conveying roller section drives again, and V3 ranging from $0.99\times V2$ to $1.012\times V2$, and an average particle diameter of a toner to be used is equal to or less than 7 μm.

2. The image forming apparatus as set forth in claim 1, wherein $$V1\times1.005\leqq V2=V3\leqq V1\times1.03.$$

3. The image forming apparatus as set forth in claim 1, wherein the recording material conveying roller section includes a pair of rollers that are a driving roller and a driven roller.

4. The image forming apparatus as set forth in claim 1, wherein on the basis of an elapsed time since a restart of the exertion of the driving force of rotation of the recording material conveying roller section, the roller section control means detects whether or not the front edge of the recording material has reached the transfer nip portion.

5. A computer-readable recording medium recording a program for controlling an image forming apparatus which forms on an electrostatic latent image bearing member an electrostatic latent image based on image information, visualizes the electrostatic latent image by a developer so as to obtain a visible image, and causes a transfer device to transfer the visible image to a recording material at a transfer nip portion while conveying the recording material, wherein said program performs the following:

providing a recording material conveying roller section in front of the transfer nip portion;

conveying the recording material to the transfer nip portion; and causing the recording material conveying roller section to rotate intermittently so that the recording material and the visible image are aligned with each other by a roller section control means, wherein a roller section control means causes the recording material conveying roller section to stop exerting a driving force when a front edge of the recording material reaches the recording material conveying roller section, causes the recording material conveying roller section to restart the exertion of the driving force when a front end of the electrostatic latent image is aligned with a front end of an image writing position on the recording material and causes the recording material conveying roller section to stop exerting the driving force when the front edge of the recording material reaches the transfer nip portion, wherein V1<V2, V1<V3, V2≈V3, where V1 (mm/sec) is a peripheral velocity of the electrostatic latent image bearing member, V2 (mm/sec) is a peripheral velocity of the transfer roller and V3 (mm/sec) is a peripheral velocity of the recording material conveying roller section provided in front of the transfer nip portion after said conveying roller section drives again, and V3 ranging from 0.99×V2 to 1.012×V2, said an average particle diameter of a toner to be used is equal to or less than 7 μm.

6. The image forming apparatus as set forth in claim 1, wherein the roller section control means causes the recording material conveying roller section to stop exerting the driving force when a front edge of the recording material reaches the recording material conveyor roller section.

7. The image forming apparatus as set forth in claim 6, wherein the roller section control means causes the recording material conveying roller section to restart the exertion of the driving force when a front end of the electrostatic latent image is aligned with a front end of an image writing position on the recording material.

8. An image forming method for forming on an electrostatic latent image bearing member an electrostatic latent image based on image information, visualizing the electrostatic latent image by a developer so as to obtain a visible image, and causing a transfer device to transfer the visible image to a recording material at a transfer nip portion while conveying the recording material, the image forming method comprising:

providing a recording material conveying roller section in front of the transfer nip portion;

conveying the recording material to the transfer nip portion; and causing the recording material conveying roller section to rotate intermittently so that the recording material and the visible image are aligned with each other by a roller section control means, wherein the roller section control means causes the recording material conveying roller section to stop exerting a driving force when a front edge of the recording material reaches the recording material conveying roller section, causes the recording material conveying roller section to restart the exertion of the driving force when a front end of the electrostatic latent image is aligned with a front end of an image writing position on the recording material and causes the recording material conveying roller section to stop exerting the driving force when the front edge of the recording material reaches the transfer nip portion, wherein V1<V2, V1<V3, V2≈V3, where V1 (mm/sec) is a peripheral velocity of the electrostatic latent image bearing member, V2 (mm/sec) is a peripheral velocity of the transfer roller and V3 (mm/sec) is a peripheral velocity of the recording material conveying roller section provided in front of the transfer nip portion after said conveying roller section drives again, and V3 ranging from 0.99×V2 to 1.012×V2, and an average particle diameter of a toner to be used is equal to or less than 7 μm.

9. The image forming method as set forth in claim 8, wherein $$V1\times1.005\leqq V2=V3\leqq V1\times1.03.$$

10. The image forming method as set forth in claim 8, wherein the recording material conveying roller section includes a pair of rollers that are a driving roller and a driven roller.

11. The image forming method as set forth in claim 8, wherein on the basis of an elapsed time since a restart of rotation of the recording material conveying roller section, the roller section control means detects whether or not the front edge of the recording material has reached the transfer nip portion.

12. The image forming apparatus as set forth in claim 1, wherein:

the transfer device includes a transfer roller which is provided in such a manner as to be compressed against the electrostatic latent image bearing member via the recording material; and an electric field whose polarity is opposite to a polarity of an electric charge of the developer is applied to the transfer roller.

13. The computer-readable recording medium as set forth in claim 5, wherein the transfer device includes a transfer roller compressed against the electrostatic latent image bearing member via the recording material, and an electric field whose polarity is opposite to a polarity of an electric charge of the developer is applied to the transfer roller.

14. An image forming method as set forth in claim 8, wherein the transfer device includes a transfer roller compressed against the electrostatic latent image bearing member via the recording material, and an electric field whose polarity is opposite to a polarity of an electric charge of the developer is applied to the transfer roller.

* * * * *